US006779306B2

(12) United States Patent
Hörmann

(10) Patent No.: US 6,779,306 B2
(45) Date of Patent: Aug. 24, 2004

(54) CABLE DRIVE GARAGE DOOR OPENER

(75) Inventor: Michael Hörmann, Oerlinghausen (DE)

(73) Assignee: Marantec Antriebs-und Steuerungstechnik-GmbH & Co. KG, Marienfeld (DE)

( * ) Notice: Subject to any disclaimer, the term of this patent is extended or adjusted under 35 U.S.C. 154(b) by 116 days.

(21) Appl. No.: 09/953,823

(22) Filed: Sep. 17, 2001

(65) Prior Publication Data

US 2002/0066231 A1 Jun. 6, 2002

(30) Foreign Application Priority Data

Sep. 15, 2000 (DE) ..... 100 45 767
Sep. 25, 2000 (DE) ..... 100 47 372

(51) Int. Cl.[7] ..... E05F 15/16

(52) U.S. Cl. ..... 49/199; 49/198; 49/358; 160/193

(58) Field of Search ..... 49/199, 198, 197, 49/360, 324, 332, 347, 358; 160/188, 193

(56) References Cited

U.S. PATENT DOCUMENTS 1,652,186 A * 12/1927 Strauss ..... 49/9
1,687,147 A * 10/1928 Sawyer ..... 49/9
1,698,424 A * 1/1929 Banschbach ..... 49/9
1,796,660 A * 3/1931 Morse ..... 160/188
2,598,709 A * 6/1952 Morris ..... 74/89.14
2,612,371 A 9/1952 Hall
2,628,090 A * 2/1953 Verdier ..... 160/193
2,755,081 A * 7/1956 Johnson et al. ..... 160/188
4,102,382 A * 7/1978 Vesbach ..... 160/188
4,248,016 A 2/1981 Pecchioni
4,597,428 A * 7/1986 Iha ..... 160/188
4,653,565 A 3/1987 Iha et al.
6,089,304 A * 7/2000 Mullet et al. ..... 160/209

* cited by examiner

*Primary Examiner*—Gregory J. Strimbu
(74) *Attorney, Agent, or Firm*—Dilworth & Barrese LLP

(57) ABSTRACT

A drive for doors, in particular garage doors, having door runners which are in each case arranged laterally and which are guided in fixed position rails, and having a drive unit having at least a motor and a driving gear. The drive unit has two rope pulleys arranged to oppositely rotate, with the two free ends of a respective rope being wound on each rope pulley. The rope ends cooperate with the door runners such that the door can be opened or closed via the rotational movement of the rope pulleys.

19 Claims, 3 Drawing Sheets

10
12
14
16
18
20
22
24
26
28
30
32
34
36
38
40
42
44
46
48
50
52
54

CABLE DRIVE GARAGE DOOR OPENER

BACKGROUND OF THE INVENTION

The invention relates to a drive for doors, in particular garage doors, in which are arranged in each case laterally at the moving parts of the door and which are guided in stationary running rails, and having a drive unit consisting at least of a motor and a driving gear.

Power driven doors are widespread. A frequent application is a power driven garage door. Such doors are frequently designed as sectional doors consisting of a plurality of slats arranged horizontally on top of one another, with the respective slats being guided via door runners in running rails located at the right and left hand sides. The running rails installed vertically at the wall side change into a horizontal position parallel to the building ceiling via a curved bend. The door runners run through the vertical rails, through the rail bend, up to the horizontal end position from the closed to the open position of the door. The upper door runners of the upper end slat are frequently guided in a separate rail which is arranged directly above the horizontal rail. This rail does not move into the vertical region via a bend, but extends in roughly a straight line with at best only a little inclination up to the lintel. The upper slat can in this way be tightly flipped at the side frame and at the lintel. The drives for the said doors usually consist of a carriage which can be moved to and fro in a drive rail and which is coupled to the upper slat of the sectional door via a door catch or a doorbar. The drive consists of at least one motor and one driving gear via which the chain or driving belt moving the carriage to and fro in the drive rail is driven.

In addition to the above-described sectional door, other door leaf designs, such as one-piece swinging doors are also opened or closed via the carriages moving to and from in the drive rail.

The above drives have the disadvantage that the drive rails have to be arranged centrally in the building ceiling, for example the garage ceiling, and that a corresponding movement free space has to be kept free in the region of the building ceiling for the door catch which can be moved along the drive rail.

SUMMARY OF THE INVENTION

It is the object of the invention to provide a drive for doors which, on the one hand, is simply constructed and, on the other hand, can be arranged in a space saving manner.

This object is solved in accordance with the invention by means of a drive for doors in accordance with the invention. The drive of the invention is a rope drive in concept. Here, two counter-rotating drive shafts are provided on a drive unit consisting of at least one motor and one driving gear. A rope with two free ends is respectively wound on each rope pulley. The rope ends cooperate with the door runners arranged to the side at the doors for the opening or closing of the door such that the rotational movement of the rope pulleys is converted into a translation of the door runners. The rope ends can also cooperate with the door edges instead of with the door runners for the opening or closing of the door such that the rotational movement of the rope pulleys is transmitted to the door edges. As a result, all embodiments in the following, which are designed with respect to the door runners, can also be transmitted to embodiment versions in which the rope ends engage at the door edges.

In accordance with the invention, the drive unit can be arranged directly on the door leaf in the event of a swinging door leaf or on a slat in the event of a section door consisting of slats. Alternatively, if this is made necessary, for example, by the space relationships, the drive unit can be arranged in a fixed position, for example at the garage ceiling. In this case, the ropes are guided via a corresponding deflection, for example deflector pulleys, and connected to the door runners such that these can be set into a translatory movement along the running rails by a driving of the rope pulleys in order to open or close the door leaf.

In accordance with an advantageous aspect of the invention, the free ends of each rope can be respectively fixed at fixed points at sides opposite one another in the longitudinal extension of the running rails, with the rope ends being respectively guided between the rope pulley and the fixed point via rope deflections cooperating with the door runners. The rope deflections connected to the door runners can be separable and thus can be installed without dismantling the door runners.

The rope pulleys can advantageously have a longitudinal borehole through which the rope is guided before the ends are wound on the rope pulleys. When the rope pulleys are rotated, one end is shortened thereby and wound onto the rope pulley to the extent in which the other end is extended, i.e. wound off the rope pulley.

Rope grooves can advantageously be provided on the rope pulleys for the better guiding of the ropes, with different directions of pitch being realised for the rope pulleys located next to one another.

The driving gear of the drive unit is realised in a particularly advantageous manner by a worm gear, with a centrally arranged worm meshing with gears fixedly arranged at the rope pulleys in each case. The power driven worm is here arranged centrally between the two gears.

BRIEF DESCRIPTION OF THE DRAWINGS

Further details and advantages of the invention are explained in more detail by way of an embodiment represented in the drawing.

There are shown.

DESCRIPTION OF THE PREFERRED EMBODIMENTS

Figures 1, 2, 3:
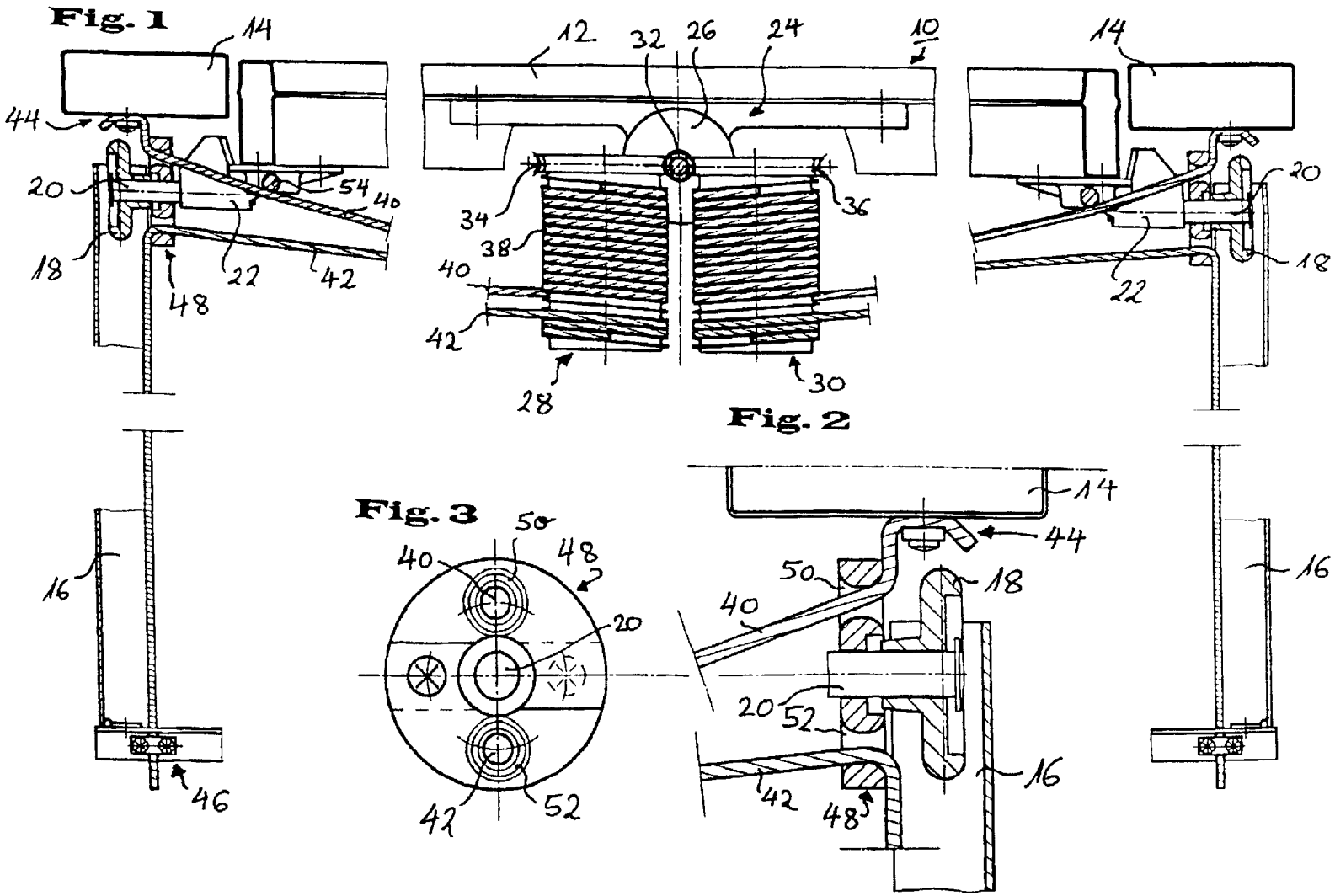
FIG. 1: a partly sectioned representation of the upper door region with a drive in accordance with an embodiment version of the present invention.
FIG. 2: an enlarged detail in accordance with FIG. 1, in which the door runner is shown in enlarged section.
FIG. 3 a plan view from the rear of the deflection device connected to the door runner.

In the embodiment represented in the drawing, a drive for a garage door is shown by way of example. In FIG. 1, the upper door region of a sectional door 10 is shown.

The topmost sectional door slat 12 of the sectional door 10 is shown which is bordered at the sides by fixed door side frames 14. Substantially horizontally extending running rails 16 are let into the garage ceiling in a known manner. Door runners 18 roll along these rails during the opening or closing movement of the sectional door 10. The door runners 18 are respectively rotationally supported on a shaft which is rigidly connected to the topmost slat of the sectional door via a holder 22. The drive unit 24 is additionally centrally fixedly arranged on the topmost door leaf 12. Said drive unit 24 consists of an electric motor 26 and a driving gear shown only schematically in FIG. 1. Two counter-rotating drive shafts, on which rope pulley 28 and 30 respectively are arranged in each case, are led out of the drive unit 24.

The driving gear for the driving of these rope pulleys 28 and 30 substantially consists of a centrally arranged worm 32 which meshes with mutually opposite gears 34 and 36 in each case arranged diametrically to the side of it and being rigidly connected to the rope pulleys 28 and 30 respectively.

A rope 38 is respectively wound on the rope pulleys 28 and 30 respectively and has in each case two free ends 40 and 42. In the embodiment shown here, the free ends 40 and 42 respectively of the rope 38 leading off the rope pulley are fixed at stationary fixed points 44 and 46 respectively. These fixed points are, as shown here in FIG. 1, arranged at opposite sides in the longitudinal extension of the running rails 16. The fixed point 44 is arranged in an imagined extension of the running rail 16 in the region of the fixed door frame 14, while the fixed point 46 is provided at the opposite end of the running rail 16 in the region of the garage ceiling. Clamping apparatuses for the clamping reception of the rope ends 40 and 42 respectively are provided in each case at the fixed points 44 and 46. The respective rope end 40 or 42 can be braced by an appropriate release of these clamping apparatuses.

The rope ends 40 and 42 respectively are guided round rope deflections 48 connected to the door runners 18 between the fixed points 44 and 46 and the rope pulleys 28 and 30 respectively (cf. also FIG. 2 and FIG. 3). The rope deflection 48 is supported in a radially and axially movable manner on the door runner axis 20. The rope ends 40 and 42 respectively are guided through corresponding cutouts 50 and 52 respectively (FIG. 2 and FIG. 3). The free ends 40 and 42 respectively of the rope 38 are shortened or extended respectively by a rotational movement of the rope pulleys 28 and 30 respectively. In this way, the rope deflection 48, and thus also the door runner 18 via the door running axis 20, is displaced along the running rail 16. Naturally, the upper door slat 12, and with this the whole sectional door 10, is opened or closed with the door runner via the connection piece 22.

The rope deflection 48 has a low-friction surface at the points within the opening 50 and 52 at which the rope ends 40 and 42 respectively are in contact with the rope deflection. Replaceable sliding elements or also small rolling bearings can optionally be provided here. If necessary in the run of the rope ends, additional sliding or roller or rolling bearings can be provided in order to deflect the rope and to avoid rubbing points which could damage it. In FIG. 1, such a sliding element, past which the rope end 40 is led, is designated with 54.

The rope deflection 48 is, as shown in particular in FIG. 3, designed in two parts and can, for example, be separated by loosening a screw connection, without having to dismantle the door runners 18.

Figure 4:
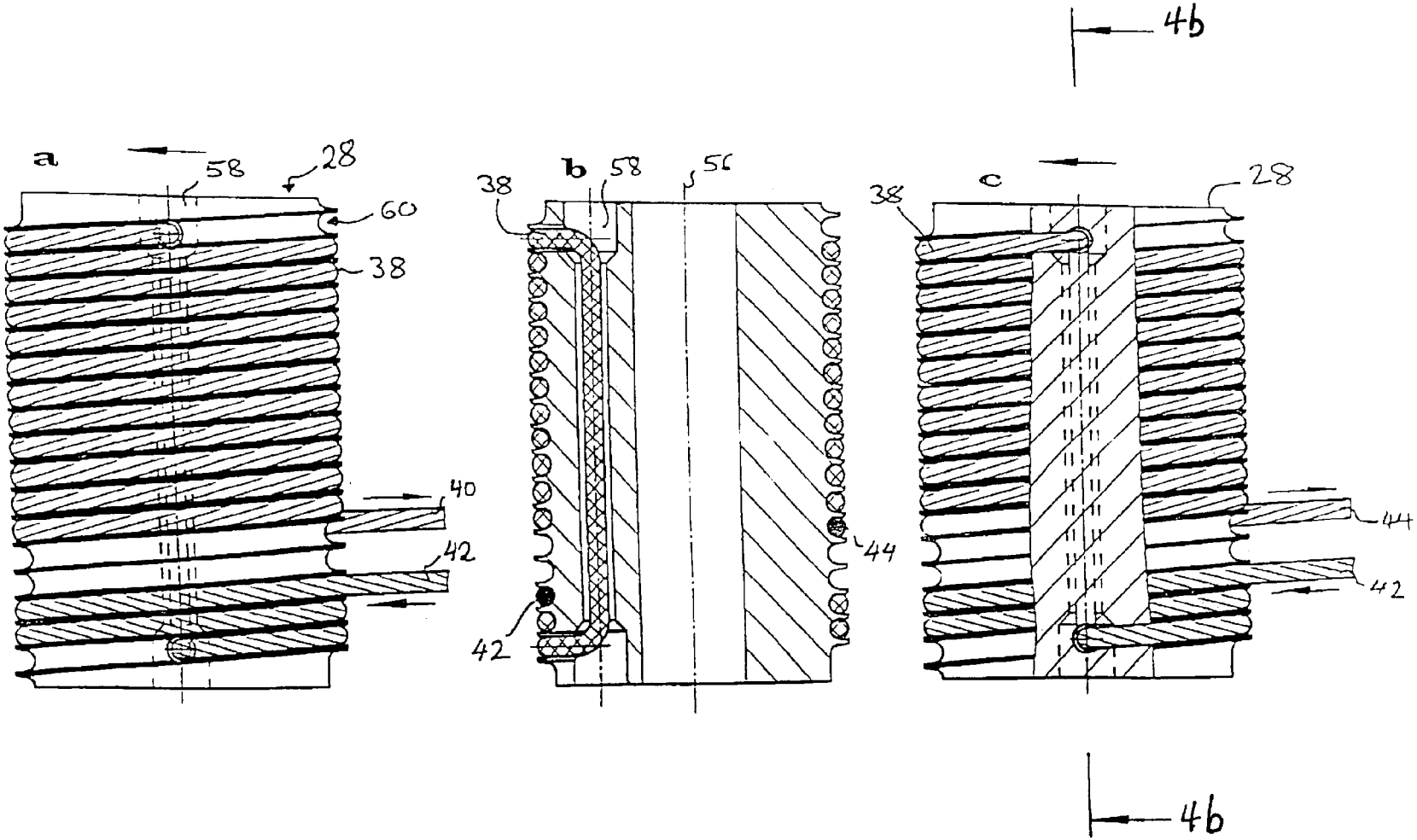
FIG. 4*a* a side elevational view of a rope pulley.
FIG. 4*b* a sectional view taken along line 4*b*–4*b* of FIG. 4*c;*
FIG. 4*c* a partially sectional view of the rope pulley of FIG. 4*a;*

In FIG. 4, the construction of a rope pulley 28 is shown, with the side view being shown in FIG. 4, while a part section is shown in sectioned form in FIG. 4*c* and a section along the section line 4*b*–4*b* of FIG. 4*c* is shown in FIG. 4*b*. The drive shaft is not shown which is led out of the drive unit and which sits on the rope pulley 28.

The rope pulley 28 has an elongate borehole 58 laterally offset with respect to the centre line 56 of the rotationally symmetrical rope pulley. Rope grooves 60 are provided on the surface to accept the rope 38. The rope 38 is, as shown in Figures a to c, guided through the elongate borehole 58 and rolled onto the rope pulley 58 along the pitch of the rope grooves which is designed with right hand thread here, with the free rope ends 40 and 42 being led away from the rope pulley to the fixed points 44 and 46 (cf. FIG. 1) not shown in more detail here in FIG. 4. If the rope pulley is, as shown by the arrow in FIG. 4, rotated counterclockwise, the rope end 40 is wound off, while the rope end 42 is wound onto the rope pulley 28 in equal measure.

Figure 5A:
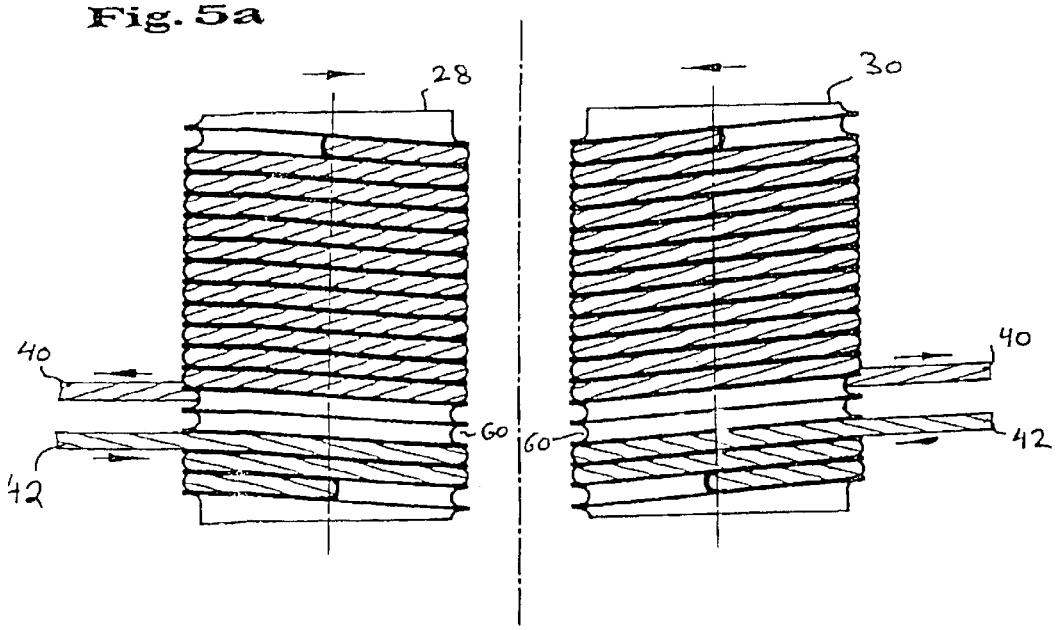
FIG. 5*a* a schematic view showing rotation of the pulleys when the door is opened.
Figure 5B:
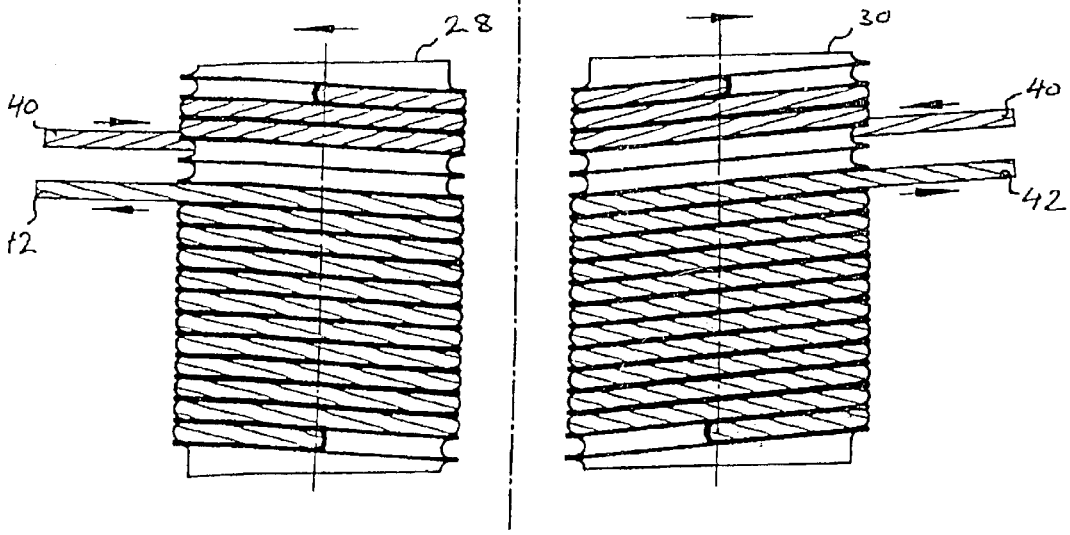
FIG. 5*b* a schematic view showing rotation of the pulleys when the door is closed.

The rope kinematics will be explained again with reference to FIG. 5. Here, both rope pulleys 28 and 30 next to one another are shown. The kinematic situation for the opening of the door is shown in FIG. 5. The rope pulley 28 has a pitch for the rope grooves 60 with a left hand thread, while the rope pulley 30 has a right hand thread of the rope grooves. In the door opening of FIG. 5*a*, the rope pulley 28 is rotated clockwise and the rope pulley 30 counter clockwise. In this case, the rope end 40 is wound off and the rope end 42 is wound up with the rope pulley 28. In the same way, the rope end 40 is wound off and the rope end 42 wound up with the rope pulley 30. Both runners 18, that is the left hand and the right hand runner 18, are thus driven in the same way. The closing of the door is shown in FIG. 5*b*. Here, the rope pulley 28 is now driven counter clockwise while the rope pulley 30 is rotated clockwise. Accordingly the rope end 40 is wound up and the rope end 42 wound off.

The different pitch directions of the rope grooves 60, as shown here, are actually not absolutely necessary for the overall function, but do effect a symmetrical rope run-in and rope run-off on both rope pulleys 28 and 30 respectively. The effective diameter of the two rope pulleys is identical in the embodiment shown here.

The number of the rope grooves 60 arranged on the circumference of the rope pulleys 28 and 30 respectively and the effective diameter of the rope pulleys determine the maximum travel path, that is the stroke of the garage door drive.

The present invention is not limited to the rope kinematics described in this embodiment. An embodiment version is rather also within the framework of the invention in which the rope ends 40 and 42 respectively are not fixed, but are tied after a corresponding deflection to the door runners or their support in order to translatorily displace the door runners in accordance with the running rails.

What is claimed is:

1. A drive comprising door runners (18) laterally arranged at edges of a door (10) and guided in respective stationary running rails (16), and a drive unit (24) comprising at least a motor (26) and a driving gear (32), wherein two counter-rotating drive shafts extend out of the drive unit (24), with a rope pulley (28, 30) respectively arranged upon each said drive shaft, a rope (38) having two free ends (40, 42) is respectively wound upon each said pulley (28, 30), the ropes (38) cooperate with the door runners (18) for opening and closing of the door (10) such that rotational movement of the pulleys (28, 30) is transmitted to the door runners (18), the free ends (40, 42) of each said rope (38) are each fixed to a respective stationary point (44, 46), said stationary points (44, 46) of each said rope being positioned at opposite longitudinal ends of a respective one of said running rails (16), and rope deflectors (48) are positioned and cooperate with the door runners (18) to guide the ropes between a respective one of the rope pulleys (28, 30) and a respective pair of said fixed points (44, 46).

2. The drive of claim 1, wherein the drive unit (24) is arranged on a leaf (12) of the door (10).

3. The drive of claim 1, wherein the drive unit (24) is arranged on a topmost slat (12) of the door (10) which is sectional and comprises a series of slats.

4. The drive of claim 1, wherein the drive unit (24) is fixedly positioned.

5. The drive of claim 1, wherein said rotational movement of the rope pulleys (28, 30) is converted into longitudinal movement of the door runners (18) along the respective running rails (16).

6. The drive of claim 1, wherein the rope pulleys (28, 30) each comprise a longitudinal borehole (58) through which a respective one of the ropes (38) is guided before the rope is wound upon the respective pulley (28, 30).

7. The drive of claim 1, wherein rope grooves (60) are arranged on the rope pulleys (28, 30).

8. The drive of claim 7, wherein the rope grooves (60) said groove (60) of one of said pulleys comprises a right-hand pitch and said groove of the other said pulley comprises a left-hand pitch.

9. The drive of claim 1, wherein the rope deflectors (48) are structured and arranged to be disconnectable from the door runners (18) and can thus be installed without dismantling the door runners (18).

10. The drive of claim 1, wherein the driving gear comprises a worm gear (32) which meshes with gears (34, 36) being rigidly connected to the rope pulleys (28, 30).

11. The drive of claim 1, wherein the rope pulleys (28, 30) each additionally comprise a longitudinal borehole (58) radially offset with respect to a center line (56) of the rope pulley (28, 30) and through which a respective one of the ropes (38) is guided before the rope is wound upon the pulley (28, 30).

12. The drive of claim 1, additionally comprising shafts (20) upon which the door runners (18) are rotationally supported and a holders (22) positioned to mount the shafts (20) upon a topmost slat (12) of the door (10).

13. The drive of claim 1, wherein for each said rope one (44) of said stationary points (44, 46) is arranged at a lateral stationary door frame (14) and the other (46) stationary point is provided in a region of a ceiling.

14. The drive of claim 1, wherein the deflectors (48) are each supported in both a radially and axially movable manner on an axis (20) of a respective one of said door runners (18).

15. The drive of claim 14, wherein each said deflector (48) comprises cutouts (50, 52) through which a respective one of the ropes (38) extends such that when a length of the rope (38) is shortened or extended by rotation of the respective one of the pulleys (28, 30), the rope deflector (48) and said respective door runner (18) are displaced along the respective running rail (16).

16. The drive of claim 15, additionally comprising a shafts upon which the door runners (18) are is rotationally supported and a holders (22) positioned to mount the shafts upon a topmost slat (12) of the door (10), such that the door (10) is opened or closed by movement of the door runners (18) and the holders (22).

17. The drive of claim 16 wherein said pulleys (28, 30) respectively comprise grooves (60) upon an outer surface thereof and the rope pulleys (28, 30) each comprise a longitudinal borehole (58) radially offset from a center line (56) of each said pulley (28, 30) and through which the respective rope (38) is guided before being wound in the grooves (60).

18. The drive of claim 17 wherein the driving gear (32) comprises a centrally arranged worm (32) and mutually opposite gears (34, 36) diametrically arranged at sides of the central worm (32), meshing with the central worm and rigidly connected to the rope pulleys (28, 30).

19. The drive of claim 1, wherein said pulleys (28, 30) rotate in opposite directions, with said ropes (38) extending laterally away from said drive unit (24) with the free ends (40, 42) of each said rope (38) coupled to the respective stationary points (44, 46) located at the opposite ends of the respective running rail (16) and each said rope (38) being coupled to a respective one of the door runners (18) such that the rotational movement of the pulleys (28, 30) is converted to translational movement of the door runners (18) along the running rails (16).

* * * * *